United States Patent [19]

Lavezzari

[11] Patent Number: 4,520,077

[45] Date of Patent: May 28, 1985

[54] PROCESS FOR THE PROTECTION OF GALVANIZED STEEL ROLLED SECTIONS WITH A TWO LAYER CHROMIUM-CHROMATE COATING

[75] Inventor: Carlo Lavezzari, Varzi, Italy

[73] Assignee: Zincroksid S.p.A., Turin, Italy

[21] Appl. No.: 585,856

[22] Filed: Mar. 2, 1984

[30] Foreign Application Priority Data

Mar. 3, 1983 [IT] Italy ..... 19880 A/83

[51] Int. Cl.[3] ..... C25D 5/12; C25D 11/38

[52] U.S. Cl. ..... 428/632; 204/27; 204/28; 204/41; 204/56 R

[58] Field of Search ..... 204/41, 38.4, 28, 27, 204/56 R; 428/632

[56] References Cited

U.S. PATENT DOCUMENTS

| | | | |
|---|---|---|---|
| 3,616,303 | 10/1971 | Carter | 204/41 |
| 3,816,082 | 6/1974 | Austin et al. | 204/28 X |
| 4,064,320 | 12/1977 | Adaniya et al. | 428/632 |
| 4,411,964 | 10/1983 | Hara et al. | 428/626 |
| 4,437,944 | 3/1984 | Bruno et al. | 204/27 |

FOREIGN PATENT DOCUMENTS

| | | | |
|---|---|---|---|
| 44417 | 9/1972 | Japan | 204/41 |

*Primary Examiner*—G. L. Kaplan

*Attorney, Agent, or Firm*—Robert E. Burns; Emmanuel J. Lobato; Bruce L. Adams

[57] ABSTRACT

A process is disclosed for the protection of steel rolled sections, in form of rolls, sheets or plates, already plated with zinc or zinc containing alloys, by means of one or more layers of an electrolytic plating, consisting of inorganic elements or compounds, preferably metal chrome and chrome oxide.

8 Claims, No Drawings

PROCESS FOR THE PROTECTION OF GALVANIZED STEEL ROLLED SECTIONS WITH A TWO LAYER CHROMIUM-CHROMATE COATING

BACKGROUND OF THE INVENTION

This invention relates to a process for the protection of rolled sheets, as a rule previously galvanized, particularly suited for use in the motor-car industry and moreover, relates to the product obtained by such a process. It is known to use electrolytic treatments based on Cr-CrOx layers on bars (unshielded) steel. As shown by U.K. Pat. No. 1,247,881, U.S. Pat. No. 3,642,587, and French Pat. No. 2,003,981, such electrolytic treatments are resorted to essentially with a view to substituting, in some cases, the white latten usually applied to metal containers and to constitute a pretreatment of a bare steel side before its hot dip galvanizing, the purpose being to prevent zinc from adhering to one of the sides, and to obtain a hot dip one side product.

French Pat. No. 2,053,038 on the other hand relates to a single-stage treatment successive to the galvanizing operation, which does not cause a multi-layer plating, but a Cr+CrOx mixture, wherein CrOx is predominant. Also the maximum deposit amount is equal to 0.650 $g/m^2$, which, according to experience, is suuboptimal for corrosion protection. Moreover, the treatment according to said French Pat. No. 2,053,038 has inconveniences so far as its industrial implementation is concerned, and its plating is unbalanced in the direction of high CrOx contents, whichh leads to a critical dissolution of the plating in either acid baths (phosphating) or significantly alkaline baths prepainting washings). Consequently there are two unacceptable effects, particularly in the motor-car industry; a great variance in corrosion-resistance tests, and contamination of phosphating baths.

Based on German patent application No. 2,114,333, there is also known a one- or two-stage process for the multi-layer treatment of galvanized or zinc-alloy plated products, according to which a Cr-CrOx plating is applied on the zinc layer, the said plating having a protective function on the galvanized product.

The process according to the above patent application essentially derives from an experiment in plating galvanized steel wires and cables. However, the possibility of extending it to flat products is also mentioned. Perhaps on account of this lack of application experience to flat rolled sheets, the process conditions specified therein and verified industrially proved unsuited to obtain a Cr-CrOx plating suitable for successive phosphating and painting processes without functional and ecologic inconveniences.

OBJECT OF THE INVENTION

According to the present invention, and as will be pointed out in the specification of the deposition mechanism of the trivalent chromium cathodic film and of its successive reaction with the $OH^-$ ions generated in the bath, to obtain chromium hydroxide, two basic parameters are to be observed.

The bath pH cannot be the that established by the water solution of chromium anhydride ($CrO_3$), which is less than 1; it must be modified by the addition of a base. (e.g. NaOH). A previous rising of the bath pH is also fundamental to prevent the chemical chromate treatment which takes place when the pH is less than 3. The said chromate treatment is not applicable to car bodies, as it consists of compounds of highly toxic hexavalent chromium compounds, which would contaminate the phosphatation baths and inhibit the paint adhesion process.

The current density shall not exceed a limit value (20 $A/dm^2$), in order to prevent higher potentials from developing which would lead to a discharge of metal chromium instead of trivalent chromium.

In the industrial reproduction of the conditions specified in the said German patent application, it has always been found that, because the pH was highly acid, there was a contemporary chromate treatment of the surface.

This was proven by the presence of hexavalent chromium ions, with colors ranging from golden yellow to green and blue, as also described in the application. The products thus realized were not considered acceptable by the motor vehicle industry.

For these reasons, the fundamental conditions of the process, the subject matter of this invention, fall within ranges of variation which are wider than those provided for by the above said German application.

The fundamental parameters for the two-stage electrolytic process which is the most suited for one of the products, described, are:

1st STAGE: Deposition of metal chromium
- Concentration of chromium anhydride
- Presence of catalyzing elements in addition to sulphate ion.
- Optimum temperature range
- Optimum current density current range 2nd STAGE: Deposition of oxide generating trivalent chromium
- Concentration of chromium anhydride
- Presence of catalyzing elements
- Current density range
- PH modification so as to prevent chromate treatment and facilitate a reaction between $Cr^{+3}$ and $OH^-$
- Optimum temperature range The above parameters are fundamental for the functional characteristics of the plating, as well as from the ecological point of view.

The scope of this invention consists in a process for the protection of galvanized flat steel rolled sections, which by means of multilayer electrolytic plating, permits an improved protection of the rolled sections, with no negative side effects.

This and other features of the invention will be made clear to the experts in the art by the following specifications and claims.

DESCRIPTION OF THE INVENTION

The process according to the invention consists in depositing by electrolytic means one or more layers of inorganic elements or compounds on top of the zinc base layer. More particularly, the process is characterized in that the electrolytic plating consists of a layer of metal chromium and a layer of chromium oxide, the plating being obtainable by means of a two- or one-stage electrolytic process.

The process according to the invention can be carried out in continuity at the end portion of a hot dip galvanizing plant or of an electrogalvanizing plant using zinc or zinc alloys, whatever the type of the plant (horizontal cells, vertical cells, circular or radial cells, tight-sealed cells for the high recirculation speed of the electrolytic solution, carousel cells, and others), or, finally, in a self-containing plant, independent of any other plating plant, whether upstream or downstream.

It is to be understood that the following definitions will be used in the specification:

the word "steel" stands for flat rolled steel sections, up to 2,500 mm wide, and 10 mm thick, cold or hot rolled, in the form of rolls or sheets;

the wording "zinc-based plating" stands for steel platings made with zinc or zinc alloys.

The zinc-based plating thickness according to the definition is to be considered as 1 to 100 μm on each plated side;

the wordings "galvanized" or "zinc-plated steels" stand for steels plated with zinc or zinc alloys, either on one or on both sides, by means of whatsoever process, such as dipping into a molten bath, or an electrolytic process, or the application of powders;

the word "galvanizing" stands for any process suitable to plate a steel surface with zinc or zinc alloys;

the word "multilayer" stands for two or more superimposed plating layers, applied in a continuous or discontinuous succession, to the same or to different installations, wherein the first plating layer, in contact with the steel, is the zinc-based layer, whatever its way of application;

the word "transport" stands for motor-vehicles, motorcycles, bicycles, industrial vehicles, farming or building tractors, buses, trains, ships and boats;

the word "body" stands for all transport parts made with flat steel rolled sections: bodyworks, chassis, suspensions, wheels, structural and covering elements.

"trivalent chromium" stands for an ion mixture essentially constituted by $Cr^{+3}$, wherein valence states other than that of $Cr^{+3}$ may be present (e.g. bivalent chromium);

"chromium hydroxide" and "chromium oxide" stand for compounds essentially of trivalent chromium, wherein there may bee present also valence states other than $Cr^{+3}$ (e.g. bivalent) chromium for which the formulas $Cr(OH)_x$ and $CrO_x$ will be used. The growing need to preserve materials and goods, in the present conditions of shortage and high cost of raw materials and of the power required for their extraction and transformation into durable goods, leads one to consider with greater attention the ways and means to protect steel from the main cause that shortens its life: corrosion.

Transport manufacturing is a huge industry, making a great use of steel. It is therefore understandable that in the last decade motor vehicle manufacturers have paid special attention to the problem of safeguarding car bodies from corrosion, and in fact all those parts which are made from flat steel rolled sections.

Besides improving the painting methods, attempts have been made to find radical solutions to the steel corrosion resistance problems by means of sections preplated with zinc-based products that is, by resorting to those steel plating products which take advantage of the cathodic or sacrificial protection from corrosion offered by zinc.

Unfortunately, however, the zinc plated steels, when submitted to a complex transformation into finished transport components (pressing, welding, painting), and successively used in heavy environment corrosion conditions have disclosed a number of substantial shortcomings.

For this reason also, the application of steel preplated with zinc-based products has been less extended than could have been expected on account of the sacrificial protection guaranteed by this type of product.

Moreover, in those cases where the application is deemed indispensable the motor car industries must afford higher transformation costs than those which have long been provided for the use of steels not previously plated (pressing scraps, welding electrodes wear, harmful welding fuses, painting problems, reduced productivity, depreciation of zinc-contaminated scraps, etc.)

The rationale of this invention is that, in order to make galvanized steel maintain all the positive properties of zinc, and loose or reduce the negative ones for its exploitation in motor vehicles and similar applications, the surface preplated with a zinc-base product should be plated with one or more successive layers, of optimal molding, welding, painting and corrosion resistance characteristics. It was found that the best way to put this into practice is to deposit electrolytically one or more layers of inorganic elements or compounds on top of the zinc-based layer. In view of the fact that the zinc-based preplating can be done on one or both sides of the flat steel rolled section, the following electrolytic deposit combinations are possible:

on one side only, (previously galvanized) in the case of "one side" zinc-base preplating;

on both galvanized sides, in the case of "two side" zinc-base plating;

on one side only of the two previously galvanized sides in case of "two side" zinc-base plating. In this case the electrolytic deposit is not present on one of the two zinc-base sides.

Ideally, the electrodeposition of successive layers on zinc-base preplating takes place on the same galvanizing line; to the final portion of its suitable installations are added. However, electrodeposition is also possible outside the galvanizing line, in a separate installation, built for that specific purpose. This invention covers both installation possibilities.

This invention refers also to all sorts of electrolytic deposits of organic layers, however built and whatever their number; nevertheless, we shall hereinafter refer more specifically to the fact that two electrolytic layers follow thee galvanizing process: a metal chromium layer and a trivalent chromium layer, which, through a chemical reaction with the bath, transforms itself firstly into chromium hydroxide and then into chromium oxide, by dehydration.

These are indeed the electrolytic layers (Cr-CrOx) which, after extensive experimenting, have proven to be the fittest to solve problems in connection with the production of motor vehicle bodies.

In motor vehicle manufacturing, the optimum steel plating is expected to show the following characteristics:

A. MOLDING REQUIREMENTS

A.1. The moldability should be equal to that of the basic steel.

A.2 The plating should not flake off.

A.3 It should not contaminate the molds.

A.4 If possible, it should act as a lubricant in the steel section-mold interactions.

A.5 Its contaminating element content should not be such as to depreciate the mold scraps.

B. WELDING REQUIREMENTS

B.1 The plating should not hamper the mechanic characteristics of welding spots.

B.2 It should not increase the wearing depth, nor the need to bead and replace spot resistance welding electrodes.

B3. It should not shoot harmful fumes.

C. PAINTING REQUIREMENTS

C.1 The plating should not cause undesirable phosphatation effects.

C.2 It should show good conductivity and adhesiveness to electrophoresis.

C.3 It should not bring about hydrogen craters, when the electrophoresis is of the cataphoretic type.

C.4 It should guarantee a proper paint adhesion, both immediately after application, and after the start of corrosion processes.

C.5 It should not bring about corrosion products that, on account of volume increase, may cause the paint to swell and chip off.

C.6 No surface roughness, noticeable below the paint.

D. UTILIZATION REQUIREMENTS

D.1 High resistance to all kinds of corrosion or induced microclimate, whether acid, alkaline or saline.

Although this invention refers to whatsoever type of inorganic electrolytic deposit obtainable on a previously galvanized surface, it is particularly concerned with the case wherein the first electrolytic layer following galvanization has a metal chromium base, and the second has a trivalent chromium base that, through chemical reaction with the electrolysis bath, is transformed into chromium hydroxide and afterwards, through dehydration, into chromium oxide, CrOx. All the tests made have shown that this type of multi-layer electrolytic treatment meets best all the above listed characteristics (points A to D).

Moreover, the following process suitability requirements must be taken into account in order to obtain an optimal product for the motor vehicle manufacturing industry.

E. MANUFACTURING PROCESS REQUIREMENTS

E.1 Compact additional electrolytic treatment units, to be inserted in the final part of any zinc-based plating process.

E.2 Easy treatment either on one or both sides.

E.3 Reproducibility and steadfastness, typical of electrolytic processes.

E.4 Compact productivity, also upstream of a factory blank cutting line, or upstream of a prepainting installation or of whatsoever galvanized steel finishing installation.

OUTLINE OF THE PROCESS ACCORDING TO THE INVENTION

There are two ways to carry out on galvanized steels a chromium and trivalent chromium electrodeposition process, reacting to form a layer of hydroxide, and thereafter of oxide.

Namely:

two successive stages, by depositing first the metal chromium and then the trivalent chromium, so as to generate the oxide layer, by means of separate electrolysis tanks for each deposition process.

in a single stage, by depositing first the chromium, in the final stage of the process the trivalent chromium will be caused to deposit and transform itself into chromium oxide.

Experience has shown that the two-stage process is the best for industrial applications.

There are four ways by which the process according to the invention can be carried out:

in the final area of a galvanization line;

in a separate, self-sufficient installation;

at the head of a galvanized steel finishing installation, such as, for instance, the cutting dept. of rolls into sheets;

at the head of a prepainting or plastic film application installation.

In each of the above cases, the steel surfaces, whether galvanized or not, must be suitably degreased and cleaned before they reach the chromium-trivalent chromium electrolytic treatment units.

The above is usually done in the galvanizing lines by degreasing (e.g. with trichloroethylene) and/or electrolytic pickling, and/or chemical pickling, and/or electrolytic pickling in neutral salts, and/or alkaline washing and final cleansing with water, hot if possible.

The technical aspects of this stage of the process being known, it will not be dealt with in detail; it is therefore taken for granted that the galvanized steel is clean when it reaches the electrolytic installation specified in the present invention.

TWO-STAGE PROCESS

1. Electrolytic deposition of metal chromium

The electrolytic deposition of chromium on a galvanized surface, in order to give it optimal corrosion resistance qualities, can be done by means of a first-rate combination, at least as far as the following parameters are concerned;

electrolytic bath composition electrolytic bath temperature types of anodes, and their arrangements cathodic current density.

For each of the above fundamental parameters, the specification will indicate the large value ranges wherein the process may be carried out, as well as the values which, based on experience, have proven to be optimal.

Electrolytic bath composition

The metal chromium deposition bath onto the galvanized surface consists of two fundamental components: chromic anhydride ($CrO_3$) in its capacity as supplier of $Cr^{+6}$ ions, and sulphuric acid, whose $SO_4^-$ ions act as catalysts in the electrodeposition process.

The sulphuric acid can be integrated and substituted by a sulphate. For high deposition speeds, the bath must be integrated by other catalysts.

Chromic anhydride ($CrO_3$) contents in aqueous solution possible range: 50 g/liter to 145 g/liter optimum range: 100 g/liter to 130 g/liter.

Note that when the $CrO_3$ contents are more than 130 g/liter, the hexavalent chromium content of the fumes caused by the process may constitute a danger of environment pollution in the vicinity of the treatment installation.

Therefore, the concentration should not exceed the above value. It should be noted, as a point of reference, that the maximum chromic anhydride/air cubic meter concentration admitted by the American Conference of Governmental Industrial Hygienists for an 8-hour continuous exposure, is 0.1 mg.

Sulphuric acid contents (weight ratio $CrO_3$:$SO_4^-$)

possible range: 25:1 to 250:1
optimum range: 90:1 to 110:1

Note that for ratios under 50:1 the process current efficiency is reduced approximately by 15% and that for ratios over 150:1 the efficiency is even more drastically reduced.

As previously stated, the sulphuric acid can be integrated or substituted by a sulphate, such as, for instance, strontium sulphate.

Contents of other catalyzing agents

The chromium deposition bath current efficiency is quite good when the above said $CrO_3$ and sulphate ion $SO_4^-$ contents are present.

It is possible, however, to obtain a higher current efficiency by adding other catalysts and optimizers of the bath electrolytic conductibility.

The range of such chromium plating bath variations can be so wide as to make it impossible to cover all of them. They are, in any case, quite essential to high treatment speed installations; this is a list of some of the possible treatments: addition of hydrofluoric acid and/or fluorides, and/or fluosilicic acid; and/or fluosilicates, and/or cryolite, and/or fluoboric acid, and/or fluoborates, and/or boric acid.

Addition of $F^-$, and/or $SiF_6^{-2}$, and/or $AlF_6^{-3}$, and/or $BO_3^{-3}$ ion adders possible range: 0.15 g/liter to 15 g/liter
optimum range: 1.2 g/liter to 1.7 g/liter Addition of $BF_4^-$ ion adders (40% solution)

possible range: 0.2 ml/liter to 5 ml/liter
optimum range: 0.4 ml/liter–0.6 ml/liter Note that the above fluoride based catalysts are necessary to increase the current efficiency, when, due to the high speed of the galvanized steel band which must be plated with chromium (over 20–30 m per minute) there is not enough space to obtain an adequate plating thickness. In particular, the above optimum values relate to a plant wherein the band feed is 30–40 meters per minute with 6 to 8 μm thickness of the zinc to be added.

As will be seen hereinafter, it will be necessary to resort to special lead alloy anodes, in order to contain the fluoride attack.

Bath contamination control

Due to its peculiar process, the chromic acid bath gets into contact with materials which may pass on to it some foreign matter: anodes, the zinc plated band side, the bare steel side (if it is a "one-side" product).

Moreover the bath, on account of the electrodeposition process which it must carry out, may cause the hexavalent chromium to be reduced to trivalent chromium.

Beyond given values, the presence of contaminating elements may cut down the process current efficiency.

It is a good principle that the iron, copper and zinc contents of the bath should not as a whole exceed a 10 g/liter value. To control such contents, it is advisable to provide for the possibility of recirculating the electrolytic solution by means of suitable ion-exchanger resins, not continuously, but from time to time when the solution begins to be contaminated.

Based on our experience, the treatment ought to be made every 500 tons of steel produced.

As for trivalent chromium, its presence should not be in excess of 1.5–10 g/liter, so as to prevent current efficiency reductions.

Anodes

Contrary to other electrolytic processes, insoluble anodes are used in this case. It is also possible to make use of conventional anodes consisting of copper bars plated with lead, tin-lead, antimony-lead, antimony-tin-lead, tin-silver-lead.

The electrodes can also be wholly made of lead or lead alloys.

It is important to balance the mass and surface of the anodes with the current density, in order to avoid temperature increases, particularly when using catalysts permitting operation at a high current density.

It is also possible to resort to mild steel anodes, in order to check the treatment cost. In this case, it is necessary to keep under closer control the iron ion content of the solution, hence the current efficiency reduction.

It is also possible to use graphite or titanium anodes—or alloys thereof.

Arrangement of anodes

Anodes can take any angular position—from perpendicular to almost parallel—with respect to the band feed direction.

In our experience, the best arrangement is the one wherein the anodes form an 8°–9° angle with the band feed direction. It is important to combine the angular position, length and width of the anodes so that the whole band width may remain for an equal time under the surface covered by electrodes.

The anodes' geometric arrangement, independent of their angular position with respect to the band feed axis, can be horizontal, vertical, or radial (cell and anodes' geometry).

Bath temperature

Our experience has shown that the optimum bath temperature, in the current density range adopted, is 45° to 65° C. The following table shows, by approximation, the current densities and the corresponding optimum bath temperatures.

| Temperature | Current density |
|---|---|
| 45–48° C. | 10–30 A/dm$^2$ |
| 48–55° C. | 30–45 A/dm$^2$ |
| 55–65° C. | 45–90 A/dm$^2$ |

It is advisable to identify by means of a Hull cell (measuring the current efficiency) the optimum temperature in a 30° to 80° C. field, within the above listed current ranges as a function of the bath composition, of the electrodeposition cell geometry and of the electric field. In general, if only $SO_4^{--}$ ions are present as the catalyst, it is preferable to stick to the lowest temperature range values; if other catalysts, such as flourides, are present, it is preferable to operate at the highest temperature range. In all cases, however, heat exchange should be provided for, so as to subtract the heat developed by the current passage, and keep the solution temperature at the preestablished value (ideally within ±2° C.).

Cathodic current density

The current density required for chromium electrodeposition on galvanized steel ranges from 15 to 150 A/dm$^2$. The optimal values are between 50 and 75 A/dm$^2$.

Weight of deposited chromium per surface unit

The invention relates to the electrodeposition of chromium weighing up to 5 g/m$^2$. The chromium metal layer has a thickness of at least 0.005 g./m.$^2$.

The optimal chromium weight being a fair balance between cost, treatment speed and corrosion resistance, ranges from 0.55 to 1.85 g/m$^2$.

The said weight ranges, which are translatable into plating thicknesses, can be obtained by operating under the optimal conditions of the various above parameters, in an electrodeposition area (covered by the anodes) of approximately 1 m every 20 m/minute band feed speed.

That is to say, if the band feed speed is equal to 60 m/minutes the length of the chromium electrodeposition area shall be approximately 3 meters.

The said lengths of the effective electrodeposition areas are only approximate, being influenced by the following: bath composition, cell & anode geometry, current efficiency, as well as by the way the solution is fed into the deposition area. To this end, it is advisable for the solution to recirculate countercurrent to the steel band feed.

A washing operation should be provided for at the end of the first stage, possibly with hot water, to prevent the second stage bath contamination, particularly with $SO_4^{--}$ ions.

2. Electrolytic deposition of trivalent chromium which, by reacting with the bath, supplies hydroxide and thereafter, by dehydration, chromium oxide.

The purpose of the electrolytic deposition of a trivalent chromium cathodic film on top of the electrolytic chromium layer deposited during the first galvanized steel treatment stage, is to obtain—through chemical reactions with the bath—the formation of chromium hydroxide which in turn, becoming dehydrated, leads to the formation of chromium oxide CrOx.

The function of the chromium oxide layer is to seal, to passivate the chromium and successively to fix the painting treatments; it is important to this end, that chromium compounds, with valence 3 or less, should be present.

The electrolytic deposition of the trivalent chromium cathodic film and the successive reactions can be thus clarified.

By means of fast cathodic scansions of galvanized steels, it was possible to observe the potentio-dynamic curves of chromic anhydride solutions, as well as the following successions of cathodic reactions.

At the less negative potentials (−200÷−600 mV) hexavalent chromium is reduced to trivalent chromium. Around 800 mv there is a first hydrogen formation which tends to increase the pH in proximity to the electrode; it is therefore likely that the hydroxide Cr(OH)x is formed during this stage.

For the metal chromium to deposit, more negative potentials must be attained (−1400 mV). Such electrodic reaction takes place almost at the same potentials as a high hydrogen ion reduction; therefore, there is a remarkable evolution of gaseous hydrogen.

Consequently, in the case of chromium metal deposition, the applied current densities, which fix the potential, must be higher than in the case of deposition of the trivalent chromium cathodic film. There is hydrogen evolution in both cases; such evolution is quite considerable in the case of chromium metal deposition, and it is undesirable as it reduces the current efficiency for processes purposes (chromium deposition); on the other hand, in the deposition of trivalent chromium it is essential for hydrogen evolution to take place, even if considerably less than in the previous case, to obtain the process wanted, namely the chemical reaction leading to the formation of chromium oxide.

Chromium oxide is formed from hydroxide, following natural or forced dehydration.

The electrolytic deposition of the trivalent chromium film and its successive chemical transformation into chromium hydroxide is obtainable through an optimal combination of at least the following:

electrolytic bath composition
electrolytic bath temperature
types of anodes
cathodic current density Wide value ranges within which the process can be carried out will be given for each of the above parameters, with the indication of those values which, in our experience, have proven to be optimal.

Electrolytic bath composition

The trivalent chromium deposition bath onto the chromium metal surface consists of two fundamental components: chromic anhydride ($CrO_3$) as supplier of $Cr^{+6}$ ions, and a base, such as sodium hydroxide (NaOH) as pH regulator.

Chromic anhydride ($CrO_3$) content in an aqueous solution possible range: 10 g/liter to 49 g/liter
optimal range: 35 g/liter to 45 g/liter NaOH content:

Sodium hydroxide, or any other base, shall be added only as modifier of the pH, which must assume the following values:

possible range: pH greater than 2
optimal range: pH from 3 to 5

Should the pH be from 0 to 3, there is the danger of chemical passivation due to surface chromatation. The chemical chromatation salts contain highly toxic hexavalent chromium, which is unsuitable for motor vehicles.

Also in the case of trivalent chromium electrodeposition it is possible to add to the bath some catalysts and activators of the solution conductibility, as in the previously mentioned case of chromium metal deposition. It is preferably not to resort to sulphuric acid or sulphates, in view of the fact that they are specific catalysts for the chromium metal electrodeposition, and not of that of trivalent chromium.

Bath temperature

The trivalent chromium deposition is fostered by lower temperatures than those needed for the deposition of metal chromium:

possible range: 10° to 45° C.
optimal range: 20° to 25° C.

Therefore, the heat generated by the current passage must be taken away from the composition, by means of an exchanger.

Anodes

The types of anodes and their angular position in respect of the band feed axis are similar to those specified for chromium deposition. The same is true for cell geometry and anode distribution (horizontal, vertical or radial).

Current density possible range: 1 to 21 $A/dm^2$
optimal range: 10 to 18 $A/dm^2$ Weight of deposited chromium oxide per surface unit The trivalent chromium cathodic film, deposited on the previously applied first layer of metal chromium, reacts with the interface solution, enriched with $OH^-$ ions for the discharge of hydrogen, thus producing chromium hydroxide through chemical reaction.

Chromium hydroxide, having being washed with hot water jets and dried with hot air jets, tends to dehydrate and transform itself into chromium oxide (CrOx).

The weight of chromium oxide deposited per area unit is calculated on the basis of its chromium content.

The present invention relates to the following chromium weight ranges as chromium oxide:

possible range: up to 1 $g/m^2$ and at least 0.001 g/m thick
optimal range: 0.035–0.085 $g/m^2$ The resulting surface unit weight ratio between the metal chromium and the chromium present in the oxide, may range from 150:1 up to 0.15:1, however, its optimal values, of economic and industrial interest range from 25:1 to 4:1. These Cr:Cr (in CrOx) ratios are those which turned out to be optimal in the product tests, in terms of molding, welding, painting and corrosion resistance.

As previously stated, after the second electrolytic treatment stage, the multilayer plated steel band is washed possibly with hot water, and then dried with hot air jets. Moreover, a passage into a 100°÷300° C. stove can be provided for to facilitate the dehydration of hydroxide.

In our experience, anyhow, dehydration can also take place in a natural way, and there are no characteristic differences between products dehydrated naturally or in a furnace. The further possible treatments of galvanized multilayer electrolytic steel Cr-CrOx (oiling or phosphating or other equivalent treatments) are quite well known; therefore, even when mentioned, it is obvious that they are not a part of this invention.

A special treatment, based on our experience in the case of steels with multilayer one side preplating, at the end of electrochemical processes where the solutions may contaminate the unplated side, consists in mechanically brushing the latter.

All preparation, galvanizing and cleansing operations prior to the Cr and CrOx electrolytic treatment are not part of this invention.

ONE-STAGE PROCESS

Besides being in two separate stages, one for metal chromium and one for trivalent chromium transformed into chromium oxide, the multilayer electrolytic plating of the galvanized steel surfaces can also consist of a single stage where the required depositions take place in succession. This system, though of lesser industrial interest, is described in order to provide for all possible ways to obtain a multilayer electrolytic plating, the object of this invention.

As in previous cases, the one-stage process is characterized by the following parameters:

electrolytic bath composition
electrolytic bath temperature
types of anodes
cathodic current density The large value ranges within which the process can be carried out and the values considered optimal on the basis of our experience wil be given for each of the above parameters.

Electrolytic bath composition

Chromium anhydride content ($CrO_3$)

possible range: 20 g/liter to 140 g/liter
optimal range: 30 g/liter–50 g/liter

Sulphuric acid contents (weight ratio $CrO_3$:$SO_4^{--}$)

possible range: 25:1 to 250:1
optimal range: 80:1 to 100:1

Also in the single-stage process it is possible to resort to catalysts increasing the bath current efficiency, as in the two-stage process.

Content of compound suppliers of ions $F^-$, $SiF_6^{--}$, $AlF_6^{-3}$, $BF_4^-$, $BO_3^{-3}$ possible range: 0.15 g/liter to 15 g/liter
optimal range: 1 g/liter to 1.5 g/liter Electrolytic bath temperature possible range: 20° to 70° C.
optimal range: 30° to 40° C.

Cathodic current density possible range: 10 to 200 $A/dm^2$
optimal range: 30 to 50 $A/dm^2$ With regard to bath contamination control, anodes, arrangement of anodes, weight of chromium deposited per surface unit; weight of chromium oxide, ratio between the two weights, see the two-stage process specifications.

OPERATING TESTS

The operating tests were carried out with the following standard, one side plated, product:

Steel: Fe $PO_4$
Size: 1500×0.8 mm
Zinc plating thickness: 8 μm (electrolytic galvanization process)
Thickness of chromium plating: 0.84 $g/m^2$
Thickness of chromium oxide plating: 0.041 $g/m^2$ Molding The multilayer Zn-Cr-$CrO_x$ plating does not modify the basic steel moldability.
the multilayer plating does not flake up to the limit steel molding curve
the zinc plating does not crack in deformations induced by drawing, whereas it shows microcracking in more severe deformation due to stretching, or the like.
the plating does not turn out to be cracked when block lapped.

Welding

The mechanical and dimensional characteristics of the welding spots remain acceptable up to 10,000 consecutive spots, the electrode being opposite to the plated surface.

Up to 10,000 spots with a stationary welder, and up to 2,000 spots with a mobile welder, there is no need to bead the electrodes.

No zinc or chromium is detected in the analysis of fumes from 100 welding spots.

Painting

No hydrogen craters are present after primer annealing up to the application of 400 V (negative) in cataphoresis.

The paint adhesion, tested after T folding and cathodic delamination, is complete.

the cataphoretic primer thickness is greater than that obtainable on a phosphatized bare steel sheet, the electrodeposition voltage being equal.

Corrosion test

When unpainted, the multilayer plating begins to show some red corrosion in a salty mist chamber after 800 hours, i.e. it turns out to be 10 times as resistant as the conventional galvanized products with the same zinc thickness.

When painted with cathaphoretic primer, it comes undamaged out of the scab corrosion test, made according to Volvo Std 1027.

Again when painted, a cut-out cathaphoretic primer does not show any white or red corrosion in the vicinity of the cutting after 750 hours in a salty mist chamber.

It continues to protect areas with welding spots for over 750 hours in a salty mist chamber.

When mounted on a motor vehicle it passes a double Arizona Test, without showing any signs of corrosion.

It does not cause any galvanic corrosion, it if is joined with a bare steel sheet section, and painted in anaphoresis.

What I claim is:

1. A process for the protection of flat steel rolled sheets previously plated with zinc or zinc containing alloys comprising: depositing on the surface of the previous plating a layer of chromium metal having a thickness of at least about 0.55 g./m.$^2$ by electrodeposition; and then depositing on the surface of the layer of chromium metal a layer of chromium oxide by electrodeposition, wherein the chromium oxide layer has a thickness of at least about 0.035 g./m.$^2$ and the weight ratio of the chromium metal to the chromium contained in the chromium oxide in the respective deposits is from 25:1 to 4:1.

2. The process according to claim 1 in which the thickness of said chromium metal layer is about 0.55 to 1.85 g./m.$^2$ and the thickness of the chromium oxide layer is about 0.035 to 0.085 g./m.$^2$.

3. The process according to claim 1, in which the electrodepositions of chromium metal and of chromium oxide are carried out in two stages comprising:

(a) in the first stage, cathodically treating said flat rolled steel sheet previously plated with zinc or with zinc alloy in an electrolytic bath comprised of an aqueous solution of chromium anhydride and sulfate ion, wherein the chromium anhydride concentration is about 100 to 145 g./l., the weight ratio of chromium anhydride to sulfate ion is from 50:1 to 150:1, the current density is from 15 to 150 A/dm.$^2$ and the electrolytic bath temperature is from 30° to 80°C.; and (b) in the second stage, cathodically treating the flat rolled steel section previously plated with chromium metal in an electrolytic bath comprised of an aqueous chromium anhydride solution having a chromium anhydride concentration of from 35 g./l. to 45 g./l., a pH greater than 2, a current density of from 10 to 18 A/dm.$^2$ and an electrolytic bath temperature of from 20° to 25° C.

4. The process according to claim 3 in which the current efficiency of the first stage electrolytic bath is increased by adding a catalyst thereto to increase the conductivity of said electrolytic bath and in which the catalyst is selected from an acid or salt bearing an ion selected from at least one member of the group consisting of $F^-$, $SiF_6^{--}$, $BO_3^{-3}$, and $BF_4^-$.

5. The process according to claim 4 in which the acid or salt bearing an ion selected from the group consisting of $F^-$, $SiF_6^{--}$ and $BO_3^{-3}$ is added in a concentration of from 1.2 to 1.7 g./l. and an acid of salt bearing $BF_4^-$ is added in a per liter or concentration of from 0.4 to 0.6 ml. of a 40% solution.

6. The process according to claim 3 in which each electrodepositing stage is carried out by means of a cathode comprised of said flat steel rolled sheet and an anode selected from a member of the group consisting of lead, lead alloy, graphite, mild steel, titanium and alloys thereof, and in which the geometric position of the anode for each stage is at an angle in respect of the flat rolled section feed position of up to 90°, and said anode is in a horizontal, vertical or radial arrangement.

7. The process according to claim 3 in which in the first stage cathodic treatment the chromium anhydride concentration of the electrolytic bath is 100 to 130 g./l., the weight ratio of chromium anhydride to sulfuric acid is 90:1 to 110:1, the current density is 50 to 75 A/dm.$^2$ and the temperature is 45° to 65° C., and in which in the second stage cathodic treatment, the pH of the solution is 3 to 5.

8. A product obtained by means of the process according to claim 1 in which the flat rolled sheet section is in the form of a roll, plate, or sheet up to 2500 mm. wide and up to 10 μm. thick, having at least one of its sides previously plated with a zinc or zinc alloy plating of a thickness of from 1 μm to 100 μm, and in which successive electrolytic treatments have been carried out on at least one previously plated side.

* * * * *

UNITED STATES PATENT AND TRADEMARK OFFICE

CERTIFICATE OF CORRECTION

PATENT NO. : 4,520,077

DATED : May 28, 1985

INVENTOR(S) : Carlo Lavezzari

It is certified that error appears in the above-identified patent and that said Letters Patent is hereby corrected as shown below:

In the claims, Claim 8, line 4, "10 μm." should read --10 mm.--.

Signed and Sealed this

*Twenty-fourth* Day of *September 1985*

[SEAL]

*Attest:*

*Attesting Officer*

DONALD J. QUIGG

*Commissioner of Patents and Trademarks—Designate*